United States Patent [19]

Schröder

[11] Patent Number: 4,896,605

[45] Date of Patent: Jan. 30, 1990

[54] METHOD OF CUT POSITION DETERMINATION FOR PRINTING MACHINES

[75] Inventor: Thomas Schröder, Zürich, Switzerland

[73] Assignee: Asea Brown Boveri Ltd, Baden, Switzerland

[21] Appl. No.: 307,753

[22] Filed: Feb. 8, 1989

[30] Foreign Application Priority Data

Feb. 19, 1988 [CH] Switzerland ..... 622/88

[51] Int. Cl.[4] ..... B41L 3/02

[52] U.S. Cl. ..... 101/486; 250/548; 101/227; 101/228; 226/28; 226/45; 226/2

[58] Field of Search ..... 101/486, 219, 221, 224, 101/225, 226, 227, 228, 232, 248; 226/2, 4, 28, 27, 30, 45; 250/548

[56] References Cited

U.S. PATENT DOCUMENTS

| | | | |
|---|---|---|---|
| 3,280,737 | 10/1966 | Huck | 101/225 |
| 3,559,568 | 2/1971 | Stanley | 101/219 |
| 3,586,437 | 6/1971 | Dietz et al. | 101/228 |
| 4,033,263 | 7/1977 | Richmond | 101/491 |
| 4,238,999 | 12/1980 | Giani et al. | 101/224 |
| 4,366,753 | 1/1983 | Glanz et al. | 101/227 |
| 4,534,253 | 8/1985 | Seragnoli | 83/336 |
| 4,538,515 | 9/1985 | Tymkewicz et al. | 101/226 |
| 4,541,337 | 9/1985 | Schaul | 101/227 |
| 4,719,855 | 1/1988 | Cannon et al. | 101/228 |
| 4,775,087 | 10/1988 | Moser et al. | 101/228 |

*Primary Examiner*—E. H. Eickholt

*Attorney, Agent, or Firm*—Oblon, Spivak, McClelland, Maier & Neustadt

[57] ABSTRACT

A method of cut position determination for printing machines, wherein in order to ensure a synchronous running of the paper webs (P1–P4) to be folded and cut into newspapers (16) on a printing machine for rotary offset printing or rotary letter press printing, main and secondary registers (5, 7) are controlled in their position by means of servomotors (M1–M4) as a function of actuating signals ($S_{M1}$–$S_{M4}$). Above each former-introduction guide roller (10), 4 photocells (11) are arranged equally spaced next to one another, which detect brightness signals ($H_{A1}$–$H_{D4}$) from the printed surface of these paper webs at a scanning frequency of 20 khz. These brightness signals are subjected to a Fourier analysis in a microprocessor. The fundamental oscillation is evaluated, the fundamental oscillation with the greatest amplitude being selected from the 4 fundamental oscillations of each paper web. The phase position signal associated with the selected fundamental oscillation is used for calculation of one of the actuating signals ($S_{M1}$–$S_{M4}$). Consequently, the cut position of the paper webs (P1–P4) can be determined without socalled register marks or register-keeping marks made on them.

9 Claims, 3 Drawing Sheets

METHOD OF CUT POSITION DETERMINATION FOR PRINTING MACHINES

BACKGROUND OF THE INVENTION

1. Field of the Invention

The invention is based on a method of cut position determination for printing machines.

2. Discussion of Background

The present invention relates to the prior art technology as is known from DE-A1-37 07 866. There, a method and an apparatus for controlling and setting the elements of printing and cartoning machines are described, in which items of information which relate to the running through of a paper web are compared by means of an arithmetic unit. As run information, register-keeping marks, which are made on the paper web, are detected by movable and fixed reading heads, which are arranged above and below the paper web. The movable reading heads detect registerkeeping marks for the printing and the fixed reading heads detect register-keeping marks for the finishing. A screen makes possible the direct controlling and setting of the machine elements.

What is disadvantageous in this case is that register-keeping marks, or so-called register marks, have to be printed on to the paper web whose position is then to be evaluated. In newspaper printing in particular, it is undesirable to print on such register-keeping marks, as they change the product. The desired accuracy of such control systems requires a considerable technical and economic outlay both in making and in detecting the as small as possible marks.

As relevant prior art, reference is also made to the book: E. Oran Brigham, Schnelle Fourier-Transformation (Fast Fourier Transformation), 2nd edition, Munich, Vienna, Oldenbourg, 1985, pages 195, 199 and 200, from which a flow chart and a FORTRAN program for a fast Fourier transformation are known.

SUMMARY OF THE INVENTION

Accordingly, one object of this invention, is to determine the cut position of individual paper webs without register-keeping marks.

One advantage of the invention is that no movable parts are necessary for implementation of the method. The method can be applied in the case of all brand-usual printing control systems. The apparatus for implementation of the method can be retrofitted without any great outlay on already existing printing machines. The result of the cut position determination can be made available via a standardized interface for adjusting the cut-off registers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
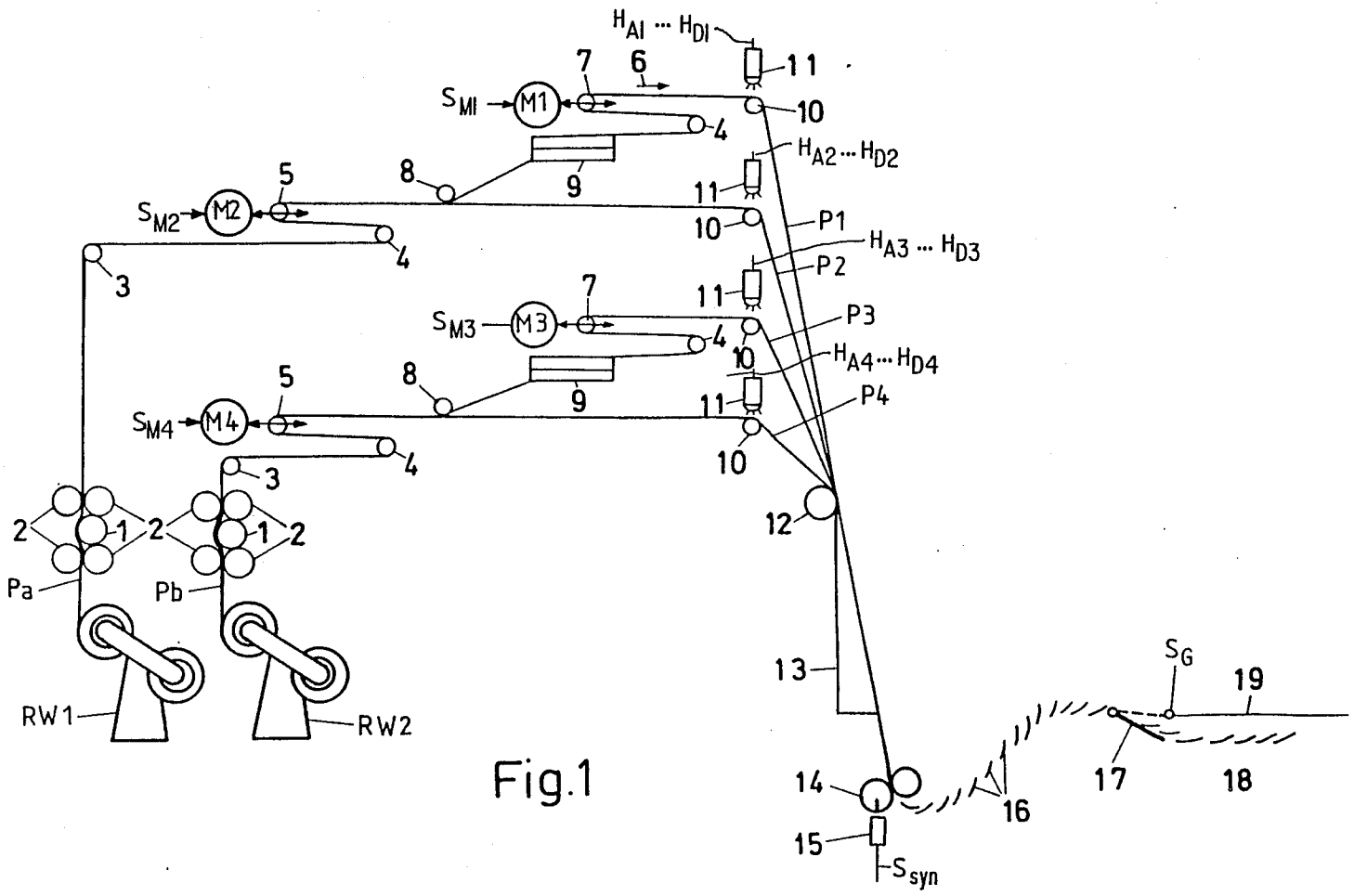
FIG. 1 shows a printing machine in diagrammatic representation.

Referring now to the drawings, in the printing machine diagrammatically represented in FIG. 1, RW1 and RW2 denote reel changers each with 2 unprinted paper reels, from which a paper web Pa and Pb, respectively, is fed in each case to a printing unit 1, 2 with an impression cylinder 1 and 4 press rollers 2. From there, the then printed paper is fed via fixed rollers and guide rollers 3 and 4 to a main register, or a register spindle 5, which is displaceable with respect to the direction of transport of the paper and can be set or controlled in its position by means of a servomotor M2 and M4, respectively. From the main register 5, the paper web Pa and Pb, respectively, passes to a knife for the longitudinal cutting of the paper web or to a cutting unit 8, in which the paper web Pa is divided into 2 equally wide paper webs P1 and P2 and the paper web Pb is divided into 2 equally wide paper webs P3 and P4.

The paper webs P2 and P4 are each transported via a former-introduction guide roller 10, a common roller or guide roller 12 and a former 13 to a folding-jaw cylinder with cross-cutting unit 14, which has a pulse generator for a synchronizing pulse or a synchronizing signal $S_{syn}$. The synchronizing signal $S_{syn}$ supplied by the pulse generator is detected by means of a pulse detector 15, preferably one pulse per revolution of the folding-jaw cylinder.

The paper webs P1 and P3 are each transported via a turner bar 9 and a roller 4 via a secondary register 7, displaceable with respect to a direction of transport 6 of the paper, each via a former-introduction guide roller 10, the common roller 12 and the former 13 to the folding-jaw cylinder 14. The secondary registers 7 are set or controlled in their position by means of servomotors M1 and M3, respectively. $S_{M1}$–$S_{M4}$ denote actuating signals for the servomotors M1–M4.

Figure 2:
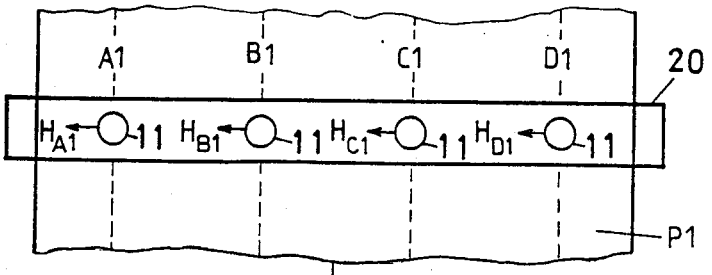
FIG. 2 shows a diagrammatic representation of the apparatus for cut position determination for a paper web of the printing machine according to FIG. 1.

Arranged one behind the other at a distance of a few millimeters above each former-introduction guide roller 10 there are 4 photodetectors or photocells 11, spaced equally apart on a photocell carrier 20, cf. FIG. 2, of which only one photocell 11 in each case can be seen in FIG. 1. Brightness signals $H_{A1} \ldots H_{D1}$ are derived or detected by the 4 photocells 11 above the paper web P1, brightness signals $H_{A2} \ldots H_{D2}$ are derived or detected by those above the paper web P2, brightness signals $H_{A3} \ldots H_{D3}$ are derived or detected by those above P3 and brightness signals $H_{A4} \ldots H_{D4}$ are derived or detected above P4.

From the common roller 12, the paper webs P1–P4 lie one above the other. They are folded in the former 13 and are folded and cut into newspapers 16 in the foldingjaw cylinder with cross-cutting unit 14. The newspapers 16 pass via a waste deflector 17 into a waste compartment 18 when in the position shown in solid lines and into a good compartment 19 when in the position shown in broken lines, in which an electric or logic good signal $S_G=1$ is emitted, otherwise $S_G=0$ is emitted. A switching of the waste deflector 17 from the waste compartment 18 to the good compartment 19 takes place whenever the main and secondary registers 5 and 7, as well as other adjustable elements which are not shown, are correctly positioned when the printing machine is started up.

FIG. 2 shows the arrangement of 4 photocells 11 on the photocell carrier 20 in a row transverse to the paper web P1. The photocells 11 have 4 mm–5 mm wide gaps (not shown), through which they detect brightness information on the surface of the paper web P1 along imaginary scanning lines A1–D1 in the paper running direction and supply brightness signals $H_{A1}$–$H_{D1}$ as a function thereof.

Figure 3:
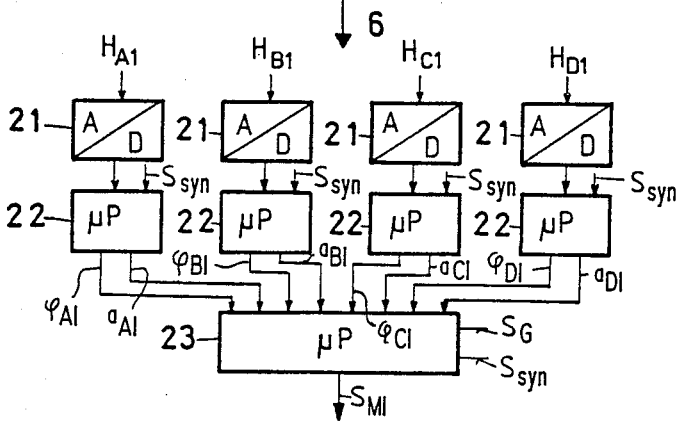
FIG. 3 shows an evaluation apparatus for determination of the cut position.

FIG. 3 shows an evaluation apparatus for cut position determination or for generation of the actuating signal $S_{M1}$ for the servomotor M1 as a function of the brightness signals $H_{A1}$–$H_{D1}$, the good signal $S_G$ and the synchronizing signal $S_{syn}$. The brightness signals $H_{A1}$–$H_{D1}$ are fed via analog/digital converters 21 to the 1st computers or microprocessors 22, in which the digitalized brightness signals are buffer-stored and subjected to a fast Fourier transformation, started by the synchronizing signal $S_{syn}$. From this, the fundamental frequency is selected and the complex number obtained in goniometric form, for example $R_{A1}+j.I_{A1}$($R_{A1}$=real part, $I_{A1}$=imaginary part) is converted into exponential form $aA_{A1.ej.\phi_{A1}}$, $a_{A1}$ signifying the amplitude and $\phi_{A1}$ the argument or the phase of the complex number, referred to the scanning line A1. An identical evaluation takes place with respect to the scanning lines B1–D1.

Figure 6:
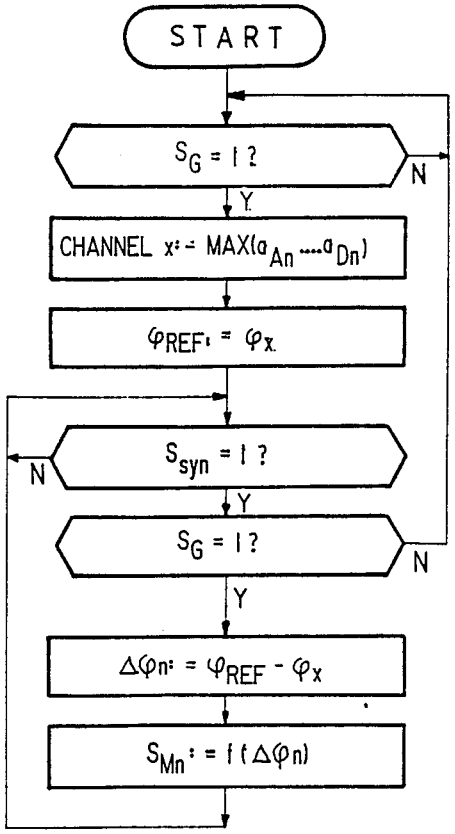
FIG. 6 shows a simplified flow chart for implementation in the evaluation apparatus according to FIG. 3.

The variables $a_{A1},\phi_{A1}$ . . . $a_{D1},\phi_{D1}$ are fed to a 2nd computer or microprocessor 23, in which the 4 amplitudes $a_{A1}$ . . . $a_{D1}$ are compared with one another. The greatest amplitude max ($a_{A1}$ . . . $a_{D1}$) is selected and with it the associated argument or the associated phase, which is to be denoted by $\phi_x$. This current $\phi_x$ is stored as reference phase position $\phi_{ref}$. The further calculations take place only for this selected channel x until the good signal is no longer issued, cf. FIG. 6. The next synchronizing signal $S_{syn}=1$ is then awaited. If the good signal $S_G=1$ continues, the phase difference $\Delta\phi 1=\phi_{ref}-\phi_x$ is calculated. The actuating signal $S_{M1}$ for the servomotor M1 is calculated as a function of $\Delta_\phi$1 and the next synchronizing signal $S_{syn}=1$ is subsequently awaited. If there was no good signal $S_G=1$, i.e. if $S_G=0$ was the case, a return is made to the start, cf. FIG. 6. There, the described sequence is represented diagrammatically in a flow chart, n standing for one of the values 1–4, i.e. for one of the measuring and evaluation channels 1–4, assigned to the paper webs P1–P4.

The secondary register 7 is controlled as a function of the actuating signal $S_{M1}$ such that the phase difference $\Delta_\phi$1 tends toward a 0. Since all registers 5 and 7 are controlled in such a way, an automatic adjustment of these registers can be achieved during operation. This is necessary in particular whenever the printing machine is brought from a low production speed to a high production speed after closing of the waste deflector 17. This acceleration causes the paper web tension, and thus the paper web length, to change, so that the main and secondary registers have to be adjusted.

Figure 4:
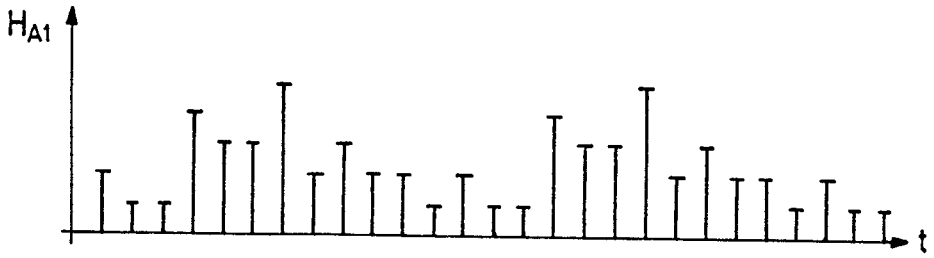
FIG. 4 shows time-dependent brightness values, as are supplied by the apparatus for cut position determination according to FIG. 2.

FIG. 4 shows, as an example, brightness signals $H_{A1}$ as a function of the time t in arbitrary units.

Figure 5:
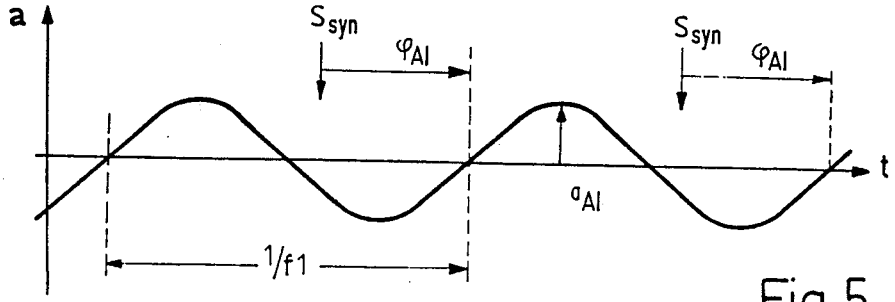
FIG. 5 shows a fundamental oscillation derived from the brightness values according to FIG. 4 by means of Fourier analysis.

FIG. 5 indicates a fundamental oscillation a, corresponding to the brightness signals $H_{A1}$ of FIG. 4 and calculated by means of Fourier analysis, with an amplitude $a_{A1}$, the frequency f1 and the phase position $\phi_{A1}$ as a function of the time t, a and t being given in arbitrary units. The two vertical arrows indicate the occurrence of the synchronizing signals $S_{syn}=1$, with respect to which the phase positions $\phi_{A1}$ are determined, which are referred on the other hand to the zero crossing of the fundamental oscillation, as indicated by broken lines.

Figure 7:
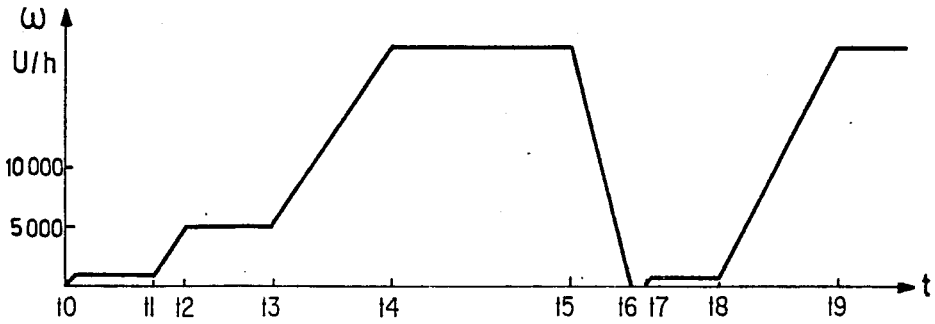
FIG. 7 shows a diagrammatic representation of the paper speed within the printing machine according to FIG. 1.

The method of cut position determination is now to be explained in more detail with reference to the paper speed diagram represented in FIG. 7, in which a rotational speed $\omega$ of a press roller 2, proportional to the paper speed, is plotted in revolutions/hour or rph as a function of the time t.

At a time tO, the printing machine is started. The relative position of the paper webs P1–P4 with respect to one another is controlled by cut-off registers, i.e. the main and secondary registers 5 and 7. The setting of the cut-off registers takes place at the beginning of each production manually by the printer at low speeds of the printing machine between the times t1–t3, with a steep rise between t1 and the time t2, in order to produce as little waste as possible. At the time t3, the printer closes the waste deflector 17 (broken-line position in FIG. 1), since the cut-off registers are correctly positioned. Thereafter, the printing machine is brought up to full speed by a time t4. The acceleration causes the paper web tension, and thus the paper web length, to change, so that the cut-off registers 5 and 7 have to be adjusted by means of actuating signals $S_{M1}$–$S_{M4}$.

Thereafter, the paper speed remains constant until an assumed paper tear at the time t5. Within about 10 s, the speed decreases to 0 at the time t6. At the time t7, the printing machine is restarted, being brought up to full speed in a time interval t8–t9.

On a printed paper web, for example P1 in FIG. 2, identically printed pages follow either directly one after the other in the "double" production mode, with the page sequence cccc . . . , or in periodic intervals in the "collect" production mode, with the page sequence cdcdcd . . . The brightness values on each paper web are scanned by means of 4 stationary photocells 11 along 4 scanning lines A1–D1, spaced equally apart, in a sufficiently fine time-slot pattern, cf. FIG. 4, so that a temporally periodic pattern of brightness values $H_{A1}$–$H_{D1}$ is produced per scanning line. By means of a Fourier analysis, the amplitude, for example $a_{A1}$, the frequency f1 and the phase position $\phi_{A1}$ of the fundamental oscillation of this periodic pattern can be determined per scanning line A1–D1, cf. FIG. 5.

Since the page sequence, and thus the frequency f1 of the fundamental oscillation, changes with the production mode, the phase difference $\Delta\phi n=\phi_{ref-\phi x,}n=1$ . . . 4, is chosen for calculation of the actuating signals $S_{M1}$–$S_{M4}$ for the cut-off registers 5 and 7. The current phase position $\phi_x$ is measured cyclically between the synchronizing signal $S_{syn}$ of the folding-jaw cylinder 14 and the next zero crossing of the fundamental oscillation, cf. FIG. 5. The reference phase position $\phi_{ref}$ is the phase position $\phi_x$ at a time t3 at which the position of the associated cut-off register 5, 7 is felt by the printer to be optimal, i.e. at which the cutting position determination is externally activated by the closing of the waste deflector 17.

The width of the paper web and its lateral position can be changed from one production to the other. In order not to have to laterally readjust for each production the photocells 11 used as brightness detectors, a photocell is fitted above the center (scanning lines A1–D1) of each of 4 imaginary zone groups of the paper web, cf. FIG. 2. Then the photocell which generates the fundamental oscillation with the greatest amplitude a is considered as active and used for determination of the actuating signal $S_{M1}$ etc. Consequently, only such zone groups on which paper is actually running are taken into account. In the event that no printing has taken place along one or more scanning lines A1–D1, the associated photocells 11 supply a constant brightness signal, i.e. the amplitude a is zero there.

Since the relative position of the paper webs P1–P4 must remain constant due to the paper cut in the foldingjaw cylinder 14, the photocells 11 are arranged as closely as possible in front of the folding-jaw cylinder 14, at best at the former-introduction guide rollers 10.

The device used for cut position determination has a central energy supply and an acquisition channel per scanning line A1–D1 of each paper web P1–P4. The interfaces are galvanically separated and correspond to brand-usual standard interfaces for printing control systems.

The good signal $S_G=1$ is only issued when the fundamental frequency f1 detected in at least one channel exceeds a predeterminable minimum frequency value $f_{min}$, when at the same time the amount of the phase difference $|\Delta\phi n|$ is less than a predeterminable maximum difference $\Delta\phi_{max}$ and the amplitude $a_{A1}$ . . . of the fundamental oscillation is greater than a predeterminable minimum amplitude $a_{min}$. Otherwise, there may be an algorithm error or a scanning error.

The scanning frequency for the brightness signals $H_{A1}$–$H_{D4}$ is 20 kHz. At a maximum rotational speed of a press roller of <50000 rph and ±0.25° accuracy, it is to be greater than 50000.360°/(3600.0.25°) Hz. The accuracy of a cut is ±0.25° of the circumference of a press roller. With a circumference of the press roller of 1400 mm, the accuracy is consequently approximately ±1 mm. The cycle time is =72 ms, at a rotational speed of <50000 rph at a maximum fundamental frequency of 14 Hz.

It goes without saying that at least 2 photocells 11 must be arranged next to each other per paper web P1–P4, but more than 4 may also be used. The method is suitable for rotary offset printing and rotary letter press printing with any number of paper webs.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A method of cut position determination for printing machines, having at least one, to be synchronously guided, printed paper web (P1–P4), identical printed product pages following directly or at periodic intervals one after the other on each paper web, wherein, (a) print-dependent brightness signals ($H_{A1}$–$H_{D4}$) are derived by at least 2 photodetectors, which are arranged for each paper web (P1–P4) next to each other with respect to the direction of transport of the latter, (b) at least a 1st oscillation signal of definable frequency (f1) is derived as a function of each of these brightness signals, provided these brightness signals are not constant, (c) the amplitude ($a_{A1}$–$a_{D1}$) is determined as a function of each of these 1st oscillation signals, (d) of the 1st oscillation signals, the one with the greatest amplitude is selected, (e) from this selected 1st oscillation signal, the current phase position ($\phi_x$,$\phi_{A1}$–$\phi_{D1}$) with respect to a predeterminable synchronizing signal ($S_{syn}$) is determined and stored as reference phase position ($\phi_{ref}$), (f) the phase difference ($\Delta\phi n$) between the current phase position ($\phi_x$) and the reference phase position ($\phi_{ref}$) is determined at an interval of at least one printed product page, and (g) at least one register of the printing machine is controlled as a function of this phase difference ($\Delta\phi n$) such that the phase difference becomes at least approximately =0.

2. A method as claimed in claim 1, wherein the 1st oscillation signal of definable frequency (f1) is obtained by means of a Fourier analysis from the brightness signals ($H_{A1}$–$H_{D4}$).

3. A method as claimed in claim 2, wherein the fundamental oscillation signal with the smallest frequency is used as 1st oscillation signal.

4. A method as claimed in one of claims 1 to 3, wherein the synchronizing signal ($S_{syn}$) is detected in dependence on a cross-cutting unit of the printing machine.

5. A method as claimed in one of claims 1 to 3, wherein the control of at least one register of the printing machine is only released when there is a good signal ($S_G=1$) derived from a waste deflector of this printing machine.

6. A method as claimed in claim 5, wherein the good signal ($S_G=1$) is emitted whenever at least one fundamental oscillation derived from a brightness signal ($H_{A1}$–$H_4$) has a fundamental frequency (f1) which exceeds a predeterminable minimum frequency ($f_{min}$).

7. A method as claimed in claim 6, wherein the good signal ($S_G=1$) is emitted whenever the amount of the phase difference ($\Delta\phi n$) is less than a predeterminable maximum phase difference ($\Delta\phi_{max}$).

8. A method as claimed in claim 7, wherein the good signal ($S_G=1$) is emitted whenever the amplitude ($a_{A1}$–$a_{D1}$) of the fundamental oscillation is greater than a predeterminable minimum amplitude ($a_{min}$).

9. A method as claimed in one of claims 1 to 3, wherein the scanning frequency, measured in Hertz, of the brightness signals ($H_{A1}$–$H_{D4}$) is greater than the rotational speed of a press roller, measured in revolutions/hour, divided by 10 times the value of the inaccuracy of the cut position, measured in degrees of angle of a press roller circumference.

* * * * *